US006775114B1

(12) United States Patent
Meid et al.

(10) Patent No.: US 6,775,114 B1
(45) Date of Patent: Aug. 10, 2004

(54) ELECTRONIC DRIVE CONTROL APPARATUS

(75) Inventors: Wolfgang Meid, Muehlheim-Kaerlich (DE); Wilhelm Melchert, Hennef (DE)

(73) Assignee: Moeller GmbH, Bonn (DE)

( * ) Notice: Subject to any disclaimer, the term of this patent is extended or adjusted under 35 U.S.C. 154(b) by 169 days.

(21) Appl. No.: 10/048,093

(22) PCT Filed: Jul. 15, 2000

(86) PCT No.: PCT/EP00/06775

§ 371 (c)(1),
(2), (4) Date: Jan. 24, 2002

(87) PCT Pub. No.: WO01/08307

PCT Pub. Date: Feb. 1, 2001

(30) Foreign Application Priority Data

Jul. 26, 1999 (DE) ..... 199 35 045

(51) Int. Cl.[7] ..... H01H 47/00; H01H 47/04
(52) U.S. Cl. ..... 361/23; 361/194
(58) Field of Search ..... 361/23, 194; 323/298, 323/297, 353, 354, 369

(56) References Cited

U.S. PATENT DOCUMENTS

| | | | | | |
|---|---|---|---|---|---|
| 3,693,029 A | * | 9/1972 | Niven, Jr. | ..... | 307/237 |
| 4,157,538 A | * | 6/1979 | Simon et al. | ..... | 340/347 |
| 4,770,178 A | | 9/1988 | Sausner et al. | ..... | 123/490 |
| 5,023,527 A | * | 6/1991 | Erdman et al. | ..... | 318/254 |
| 5,214,561 A | | 5/1993 | Morita | ..... | 361/187 |
| 5,579,194 A | | 11/1996 | Mackenzie et al. | ..... | 361/24 |
| 5,694,949 A | * | 12/1997 | Reggiardo | ..... | 128/897 |
| 5,818,678 A | | 10/1998 | Berg et al. | ..... | 361/152 |

FOREIGN PATENT DOCUMENTS

| | | | | |
|---|---|---|---|---|
| DE | 9216041 | 2/1993 | | |
| DE | 29812029 | 12/1998 | | |
| DE | 29909901 | 11/1999 | | |
| DE | 29909904 | 11/1999 | | |
| EP | 0779631 | 6/1997 | | |
| EP | 0789378 | 8/1997 | | |
| JP | 403155211 A | * | 7/1991 | ..... H03H/11/04 |

OTHER PUBLICATIONS

Murata et al. "Development of DC power contractor driving circuit for EV" EVS, Tokyo Oct. 13, 1996, pp. 593–599.

* cited by examiner

*Primary Examiner*—Brian Sircus
*Assistant Examiner*—Z Kiton
(74) *Attorney, Agent, or Firm*—Davidson, Davidson & Kappel, LLC

(57) ABSTRACT

An electronic drive control apparatus for controlling a drive coil of a contactor includes a microcontroller configured for generating an inverted pulse width modulated signal, and at least one semiconductor switch. A pulse-shaping stage is connected downstream of the microcontroller for varying the pulse width modulated signal. The pulse-shaping stage includes a preselectable RC combination and an inverter connected downstream of the RC combination and having a Schmitt trigger input. A preselection of the RC combination is carried out via a plurality of outputs of the microcontroller to open collector transistor stages of discharge resistors of the RC combination. The pulse width of the driving signal of the semiconductor switch is determined from the inverted pulse width modulated signal and the preselected RC combination.

6 Claims, 4 Drawing Sheets

ELECTRONIC DRIVE CONTROL APPARATUS

BACKGROUND

The present invention relates to an electronic drive control apparatus for controlling a drive coil of a contactor.

An electronic drive control for a magnetic drive featuring pulse width modulation of the armature current is known from European Patent Application No. EP 0 789 378 A1. The armature coil is operated with a constant voltage. U.S. Pat. No. A-5,579,194 describes an electronic drive control for controlling a drive coil of a contactor, the electronic drive control having a pulse width signal which is generated by an arithmetic unit and having a semiconductor switch. In this context, the pulse width ratio can be varied by an impulse-shaping stage connected downstream.

It is also known to use microcontrollers for control systems of that kind. During the so-called "holding mode", the pick-up current is reduced by the factor 7 to 12. To keep the holding current and, consequently, the power loss in the drive coil as low as possible, it is required for the holding current not only to be reduced but also to be maintained constant at as low a value as possible over the entire voltage range because of the large voltage range for which such control systems are intended to be usable. The frequency of a pulse width modulator (PWM) and the $T_{ON}$-time, respectively, cannot be selected arbitrarily. Because of noise generation of the magnetic circuit due to the pulsing of the drive coil, unlike the pick-up control during which this short-time noise generation is completely covered by the moving process of the entire drive, it is required for the PWM frequency for the holding mode to be fixed to a frequency which lies outside the human hearing range. Frequencies outside the human hearing range lie above 20 kHz, which corresponds to a period duration of 50 $\mu$s. Due to the required current reduction to the holding mode, a relatively short $T_{ON}$-time of, for example, 400 ns would ensue, making allowance for control, or actuating, reserves and other factors.

However, this cannot always be achieved since, when using microcontrollers, the pulse ratio of the PWM modulator cannot be adjusted arbitrarily but only as a whole-number multiple of the pulse frequency or of a variable derived therefrom. When working with controllers of that kind, oscillator frequencies of, for example, 10 MHz are usual, the oscillator frequencies being internally reduced to a pulse frequency of 1 MHz. Therefore, only a minimum of 1 $\mu$s can be adjusted as the shortest $T_{ON}$-time.

However, considerably shorter $T_{ON}$-times are necessary to avoid noises which are unpleasant for the human ear and to be able to operate such a drive in the holding mode in a manner that saves as much energy as possible, involving as low a loss as possible. Moreover, it has to be taken into account that drives of that kind are intended to be suitable for a relatively large voltage range and that the holding pulses need to be correspondingly variable.

SUMMARY OF THE INVENTION

Therefore, an object of the present invention is to provide an electronic drive control apparatus for controlling a drive coil of a contactor which allows the holding mode to be implemented over a large voltage range with little loss and noise.

The present invention provides an electronic drive control apparatus for controlling a drive coil of a contactor. The electronic drive control apparatus includes a microcontroller configured for generating an inverted pulse width modulated signal; at least one semiconductor switch; and a pulse-shaping stage connected downstream of the microcontroller, the pulse-shaping stage being capable of varying the pulse width modulated signal. The pulse-shaping stage includes a preselectable RC combination and an inverter connected downstream of the RC combination and having a Schmitt trigger input. The inverted pulse width modulated signal is switched to the preselectable RC combination and the semiconductor switch is controllable by the inverter. A preselection of the RC combination is performed using a plurality of outputs of the microcontroller to open collector transistor stages of discharge resistors of the RC combination. Moreover, a pulse width of a driving signal of the semiconductor switch is determined from the inverted pulse width modulated signal and the preselected RC combination.

The present invention allows the holding pulses to be correspondingly finely stepped, or graded. The holding power is minimized in a simple manner.

BRIEF DESCRIPTION OF THE DRAWINGS

The present invention will be elaborated upon below with reference to the drawings, in which.

DETAILED DESCRIPTION

Figure 1:
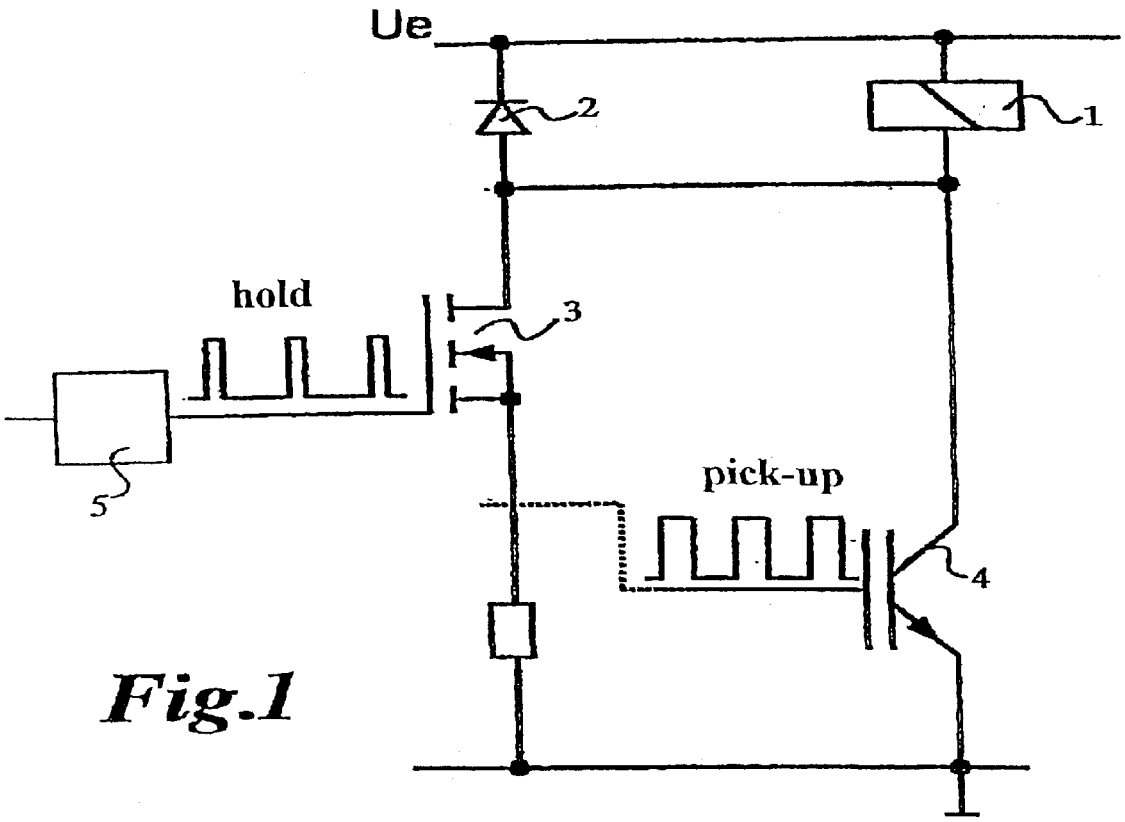
FIG. 1 shows a schematic representation of a drive coil having semiconductor switches for pick-up and holding modes.

FIG. 1 shows drive coil 1 of a contactor having a free-wheeling diode 2, a semiconductor switch 3 for the holding mode, a further srmiconductor switch 4 for the pick-up, and pulse-shaping stage 5 which is connected in series to and before the control input of semiconductor switch 3.

Figure 2:
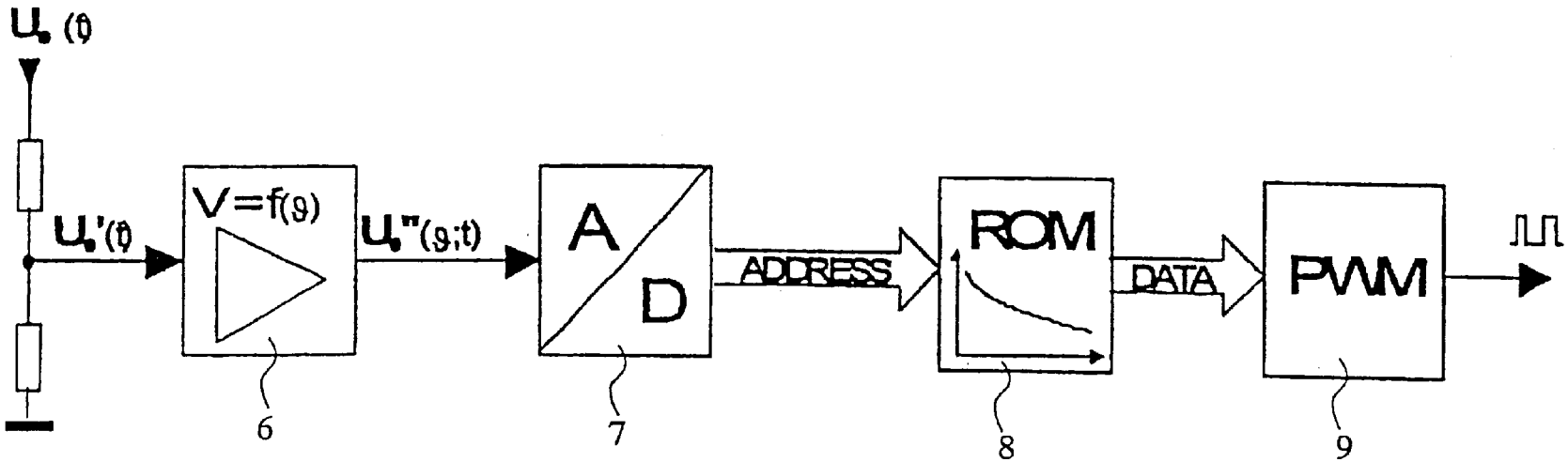
FIG. 2 shows a schematic representation of map-based control.

It is necessary for the change in resistance of the drive coil to be compensated for as a function of the ambient temperature ($\theta$), the corresponding compensating circuit being indicated by the reference numeral 6 in FIG. 2.

The temperature is already allowed for on the analog side of the voltage measurement by influencing the amplification factor of an operational amplifier 6 via a temperature dependent resistor in such a manner that the measured input voltage is multiplied by the reciprocal value of correction factor $k_T$. In this manner, a complete temperature compensation of the drive coil ensues.

Because of the computing expenditure required, the PWM is determined by a map-based control which is shown in FIG. 2. In the case of this control, the PWM values are already calculated in the preliminary stages, making allowance for all determinable, constant correction factors, and stored in a data storage unit 8 of a microcontroller as a fixed correction table. In this context, the output value of an analog-to-digital converter 7, which is used for measuring the input voltage, serves as an address pointer so that the $T_{ON}$-time or $T_{OFF}$-time appertaining to the so addressed data storage cell can be directly read out therefrom. Alternatively to the temperature compensating circuit, it is moreover possible for variable correction factor $k_I=1+\alpha_{cu}*\Delta\upsilon$ for the temperature compensation to be allowed for by means of software. This correction factor can be included in the calculation or, as implemented here, be already allowed for by "bending" the voltage vector on the analog side of the voltage measurement.

In the case of microcontrollers, the pulse ratio of PWM modulator 9 cannot be adjusted arbitrarily but rather only as a whole-number multiple of the pulse frequency or of a variable derived therefrom. In the present case, the microcontroller is operated with an oscillator of 10 MHz. The oscillator frequency is further lowered internally by a scaler 10/1 to a pulse frequency of 1 MHz so that a minimum of 1 $\mu$s can be adjusted as the shortest $T_{ON}$-time.

Consequently, the shortest $T_{ON}$-time that can be delivered by the microcontroller is longer than the time that is minimally required for the PWM signal so that an additional pulse-shaping stage is needed between the PWM output of the microcontroller and the semiconductor switch, the additional pulse-shaping stage allowing the $T_{ON}$-time of the microcontroller to be shortened correspondingly. Furthermore, this pulse-shaping stage is necessary to permit a finer resolution of the $T_{ON}$-time so as to minimize the increment of the holding current and, consequently, of the holding power ($P_{Hold}$~$I_{Hold}^2$).

Figure 3:
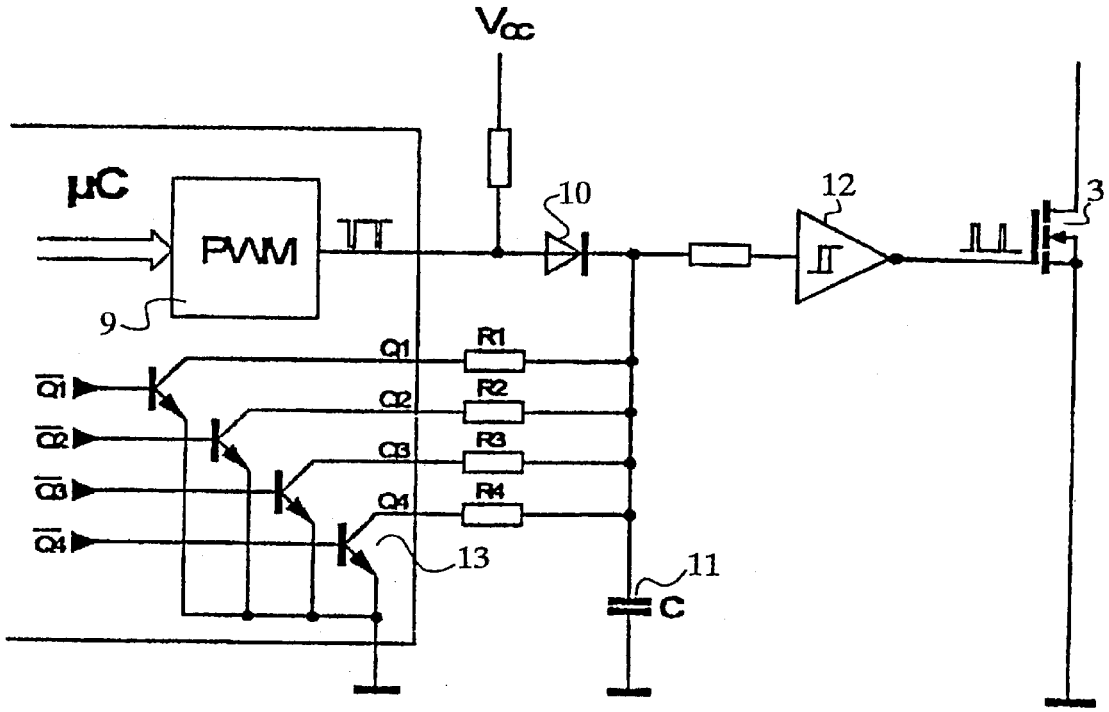
FIG. 3 shows a schematic representation of the pulse-shaping stage of the drive coil of FIG. 1.

FIG. 3 shows the design of this pulse-shaping stage 5 of FIG. 1. Here, the inverted PWM signal (open collector) of the microcontroller is switched to a capacitor 11 via a decoupling diode 10. The voltage at capacitor 11 is monitored via an inverter 12 having a Schmitt trigger input. The switching level lies at approximately 60 per cent of supply voltage $V_{CC}$. Concurrently with the falling edge of the PWM signal of the microcontroller, up to four outputs $\overline{Q1}$–$\overline{Q4}$ of the microcontroller are driven with open collector. These outputs discharge capacitor 11 via stepped resistors R1 through R4. As soon as the voltage at the capacitor has fallen below the threshold voltage, semiconductor switch 3 is driven via inverter 12. The inverted outputs $\overline{Q1}$–$\overline{Q4}$ of the microcontroller are switchable to open-collector transistor stages 13 having discharge resistors R1–R4, the pulse width of the driving signal of semiconductor switch 3 being determinable via the PWM output and the RC combination.

Figure 4:
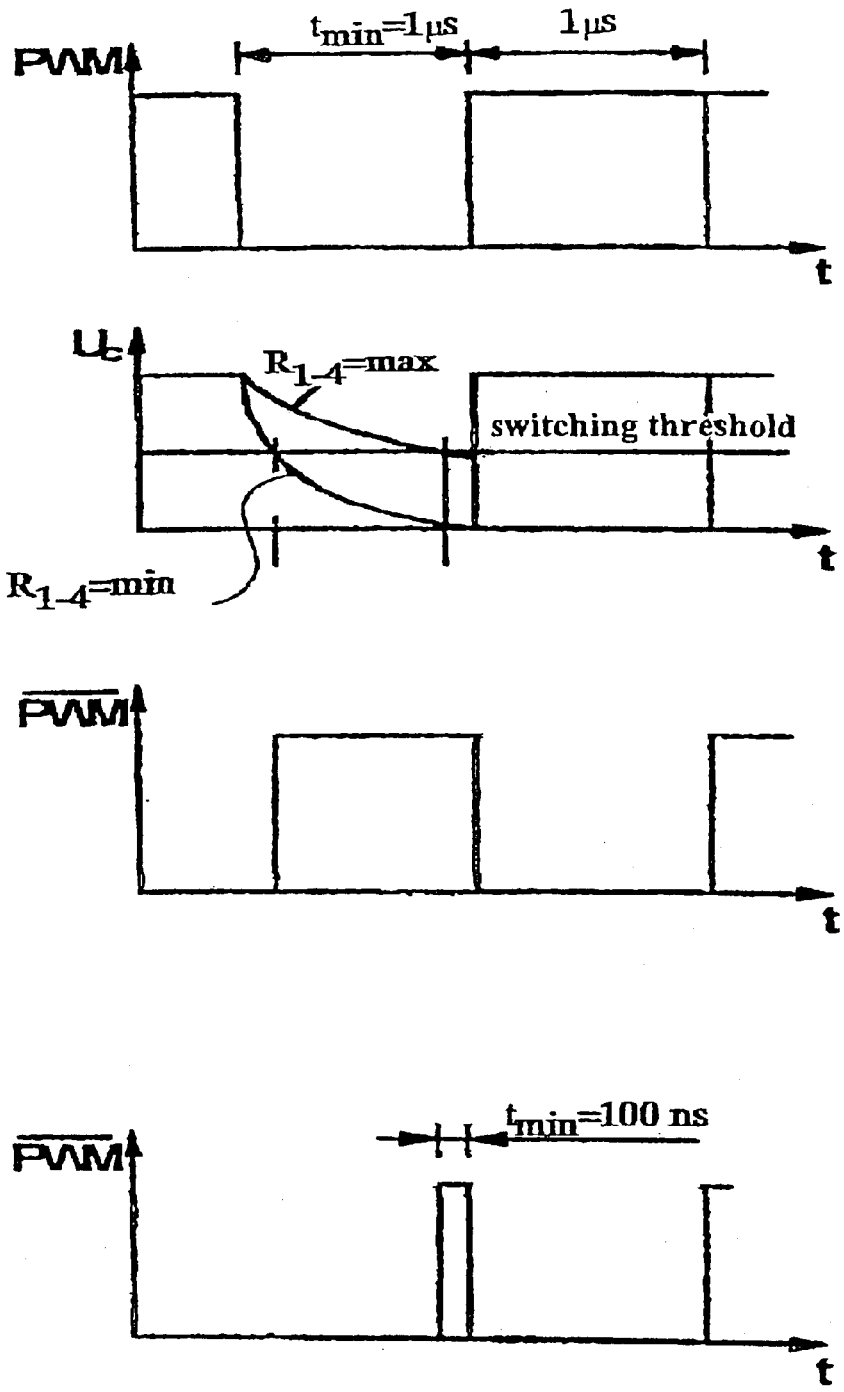
FIG. 4 shows pulse timing and voltage diagrams.

The mode of operation of pulse-shaping stage 5 (of FIG. 3) will be explained in greater detail with reference to FIG. 4:

When the PWM signal drops to 0 Volt, capacitor 11 discharges as a function of the RC time constant which is determined by R1 through R4. During a fast discharge ($R_{1\text{-}4}$=min), voltage $U_c$ decreases faster, as a result of which $U_c$ below the switching threshold of the inverter is reached faster, and which gives rise to an inverted PWM signal with large $T_{ON}$-time, as depicted in the third diagram from above. When connecting a large time constant into the circuit, the voltage at capacitor 11 decreases more slowly, resulting in a short $T_{ON}$-time, as depicted in the bottom-most diagram.

Due to a large nominal voltage range and a combined AC/DC supply, moreover, a drastic reduction of coil variants ensues. This objective can be achieved by maintaining the voltage at the drive coil constant, independently of the applied supply voltage. In the case of the design approach for high-power contactors this is achieved by a voltage-driven control. For the dynamical determination of the PWM ratio, the input voltage needs to be measured dynamically. In this context, to make possible an easy coupling of the measuring signal, the voltage is measured on the DC side downstream of a bridge rectifier not further shown. The filtering of the input voltage is carried out via a T-filter which is arranged upstream of the microcontroller.

What is claimed is:

1. An electronic drive control apparatus for controlling a drive coil of a contactor, the electronic drive control apparatus comprising:

a microcontroller configured for generating an inverted pulse width modulated signal;

at least one semiconductor switch; and a pulse-shaping stage connected downstream of the microcontroller, the pulse-shaping stage being capable of varying the pulse width modulated signal, the pulse-shaping stage including:

a preselectable RC combination; and an inverter connected downstream of the RC combination and having a Schmitt trigger input;

wherein:

the inverted pulse width modulated signal is switched to the preselectable RC combination;

the semiconductor switch is controllable by the inverter;

a preselection of the RC combination is performed using a plurality of outputs of the microcontroller to open collector transistor stages of discharge resistors of the RC combination; and a pulse width of a driving signal of the semiconductor switch is determined from the inverted pulse width modulated signal and the preselected RC combination.

2. The electronic drive control apparatus as recited in claim 1 wherein the plurality of outputs of the microcontroller include four outputs configured for resolving the inverted pulse width modulated signal in 16 steps via a corresponding graduation of the RC combination.

3. The electronic drive control apparatus as recited in claim 1 wherein a pulse width ratio of an output of the pulse-shaping stage is adjustable from 1/50 to 1/500.

4. The electronic drive control apparatus as recited in claim 1 further comprising a T-filter connected upstream of the microcontroller and configured for filtering of an input voltage.

5. The electronic drive control apparatus as recited in claim 1 further comprising a compensating circuit configured for compensating for a temperature of the drive coil, the compensating circuit having a temperature coefficient corresponding to approximately double a temperature coefficient of copper.

6. The electronic drive control apparatus as recited in claim 1 wherein the microcontroller includes a non-volatile data storage unit, a correction table including pulse width modulation values being stored in the non-volatile data storage unit.

* * * * *